United States Patent [19]

Salvarezza

[11] Patent Number: 4,683,981

[45] Date of Patent: Aug. 4, 1987

[54] MOLDED HARD ELASTOMER STEPS AND REPLACEMENT AND SPREADER STEPS FOR ROPE LADDERS AND FITTINGS THEREFOR, AS WELL AS MOLDING METHOD THEREFOR

[76] Inventor: Robert M. Salvarezza, 110 Braemar Dr., Hillsborough, Calif. 94010

[21] Appl. No.: 892,376

[22] Filed: Aug. 4, 1986

[51] Int. Cl.[4] ..... E06C 1/56

[52] U.S. Cl. ..... 182/199; 182/46; 182/228

[58] Field of Search ..... 182/46, 196, 197, 198, 182/228, 199

[56] References Cited

U.S. PATENT DOCUMENTS 4,241,809 12/1980 Salvarezza ..... 182/199
4,554,996 11/1985 Salvarezza ..... 182/199

*Primary Examiner*—Reinaldo P. Machado
*Attorney, Agent, or Firm*—Owen, Wickersham & Erickson

[57] ABSTRACT

A rope ladder of the type having two spaced-apart pairs of ropes, has a metal frame for each step and has tubular nylon members with cylindrical bores, extending vertically through sets of through openings in the metal frame for assuring accurate bolt alignment. The frame and nylon members are provided with a molded hard elastomer body molded around them and having a collar portion at each end molded around a frame bracket. The body and frame provide a through rope opening. A pair of separate wedge collars is secured, on assembly, to each step, below the step and bearing up against it. Each wedge collar has a rope opening and vertical bolt passages aligned with the bores of the tubular nylon members. A generally diamond-shaped wedge heart is placed in between each pair of ropes, in the rope openings; the wedge heart provides two rope-engaging side grooves for locking the pair of ropes in place and preventing relative movement between them and the step. Fastening bolts extend through bolt passages and the bores of the nylon members and are tightened in place to hold the wedge collar and wedge heart in place and lock the ropes in fixed position relative to said step. The molding is done with the frame inverted, the nylon members having a flange and a spacer for spacing the frame in the to-be-molded body; the nylon members extend to the opposite surface of the body. Pins of the mold extend into each end of each nylon member and assure accurate alignment. Similar nylon members are used in replacement steps in connection with horizontal bolts. An improved spreader step is also provided.

32 Claims, 16 Drawing Figures

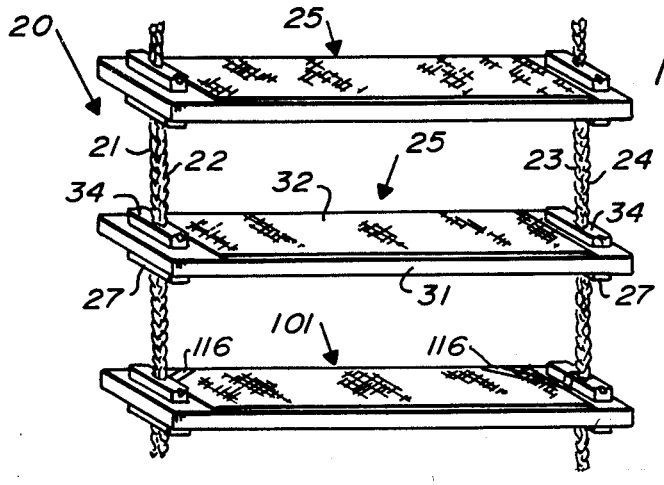
FIG. 1
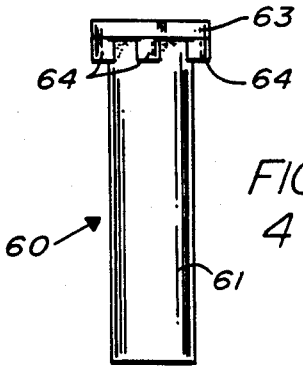
FIG. 4
FIG. 2
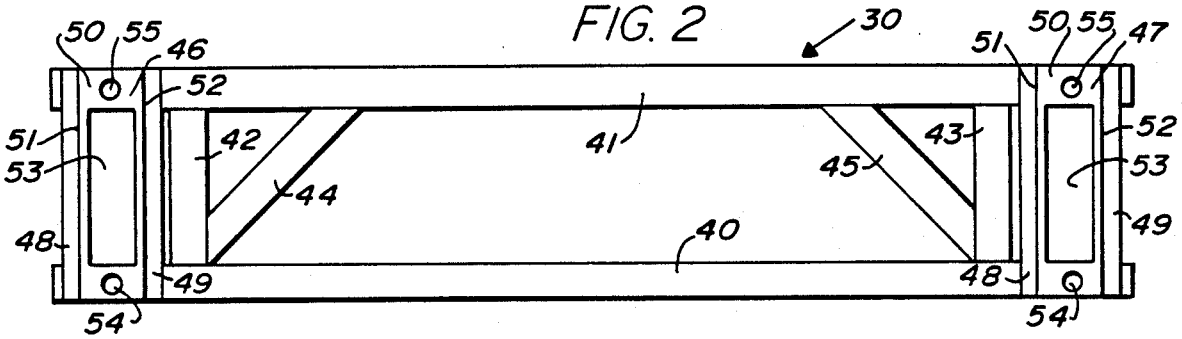
FIG. 3
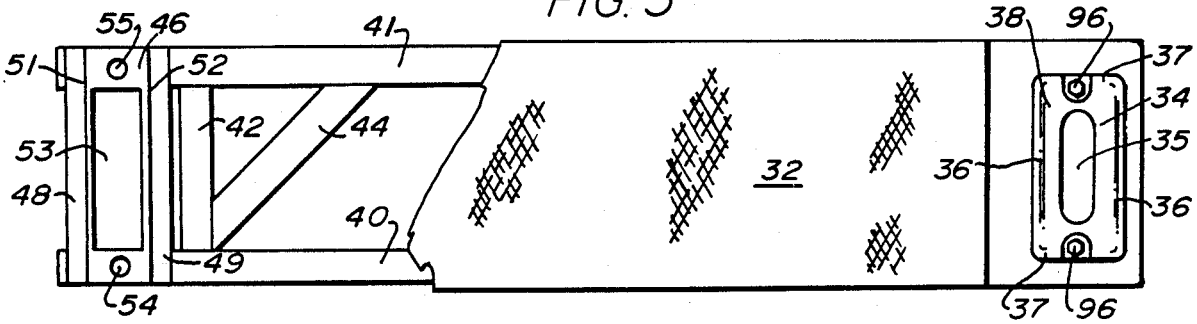
FIG. 5
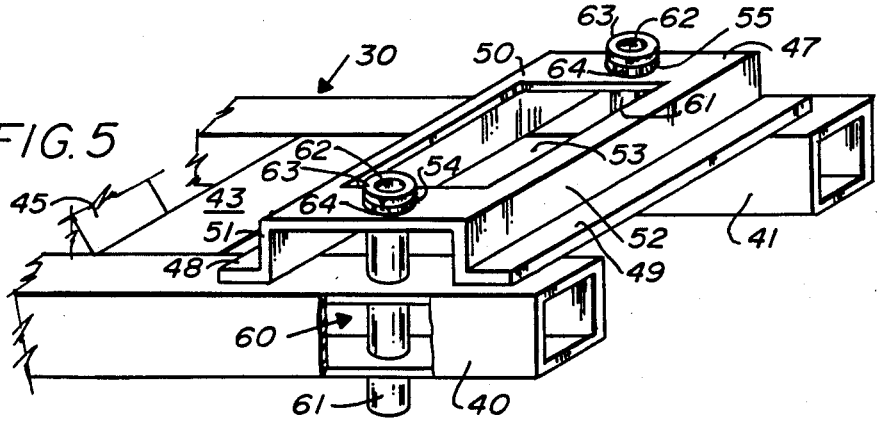

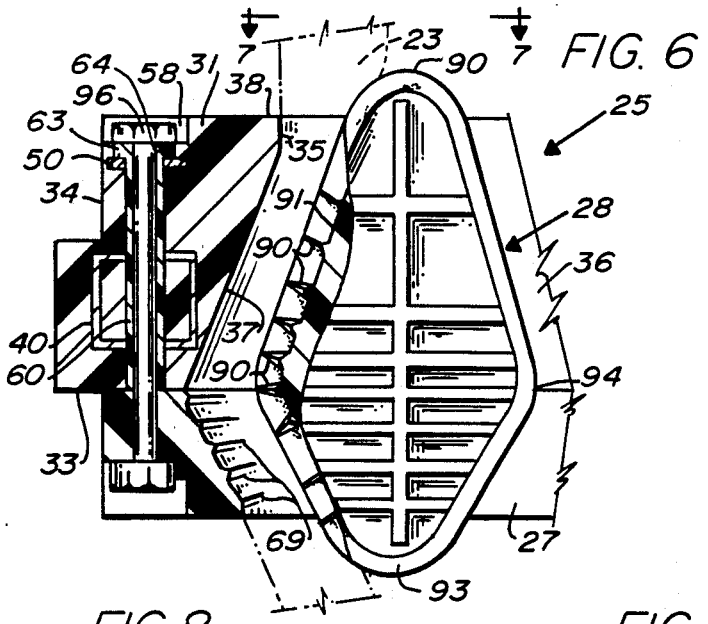
FIG. 6
FIG. 7
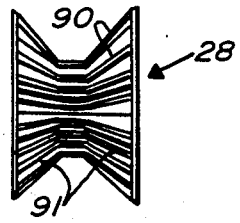
FIG. 8
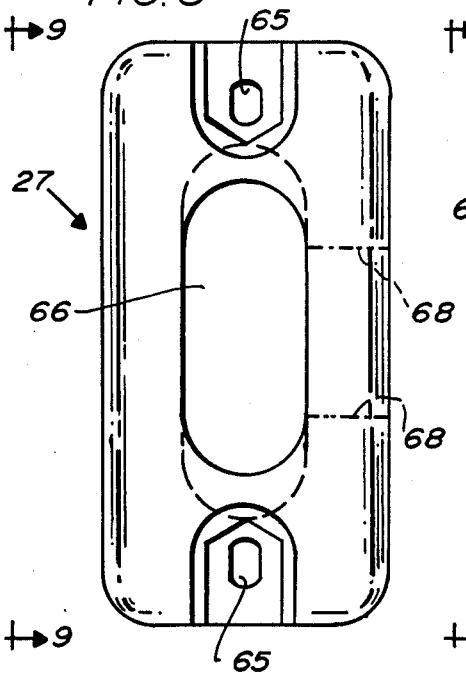
FIG. 9
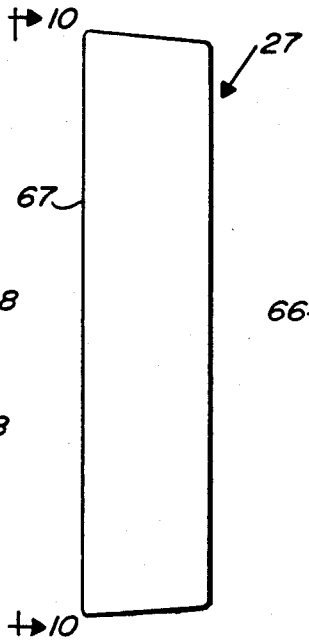
FIG. 10
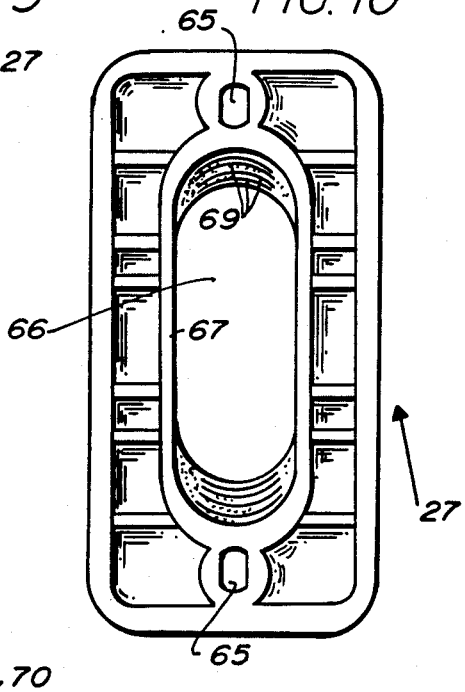
FIG. 11
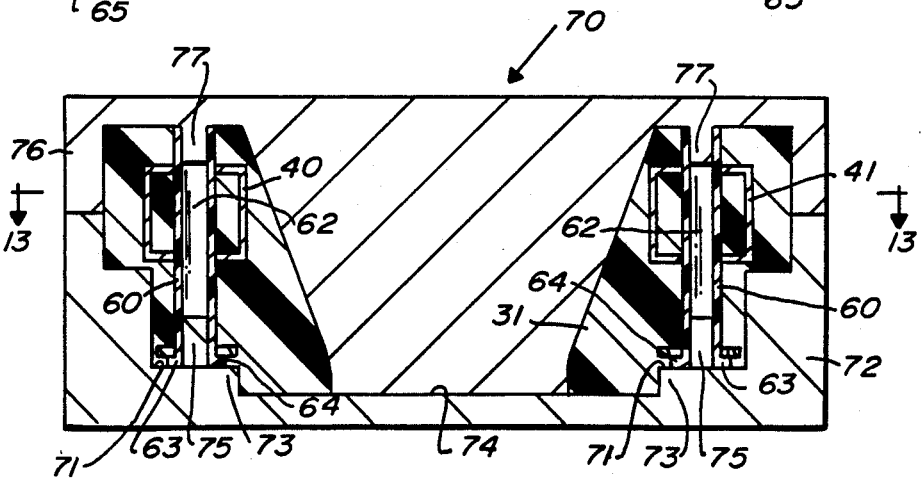

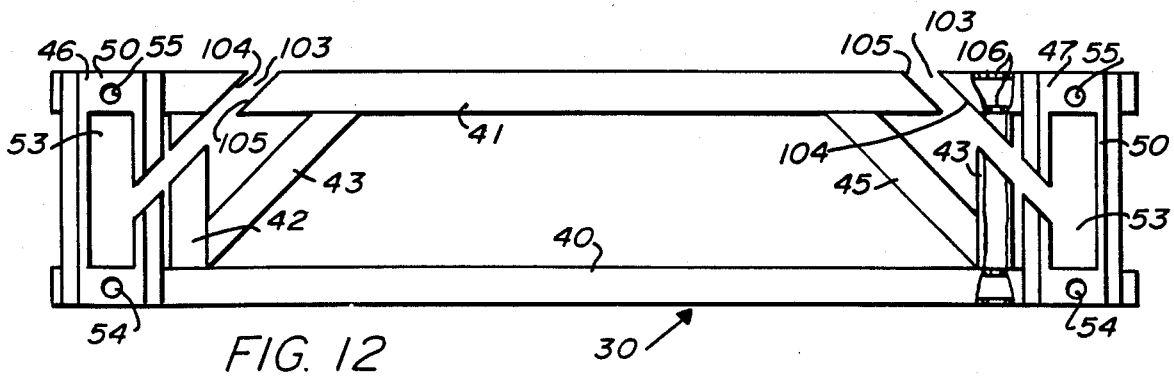
FIG. 12
FIG. 13
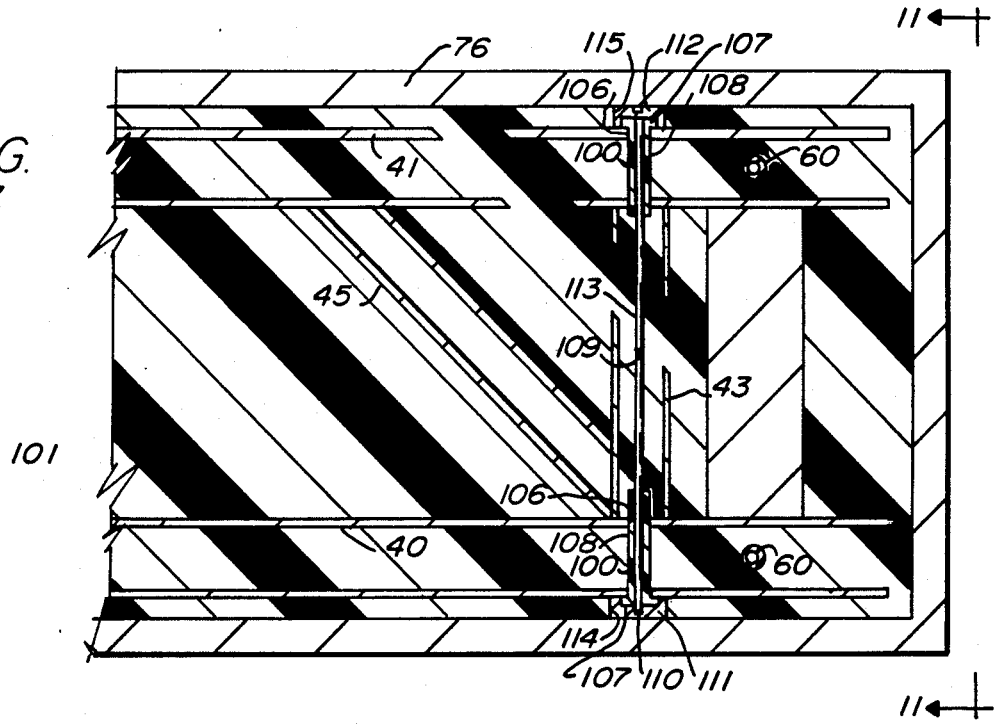
FIG. 14
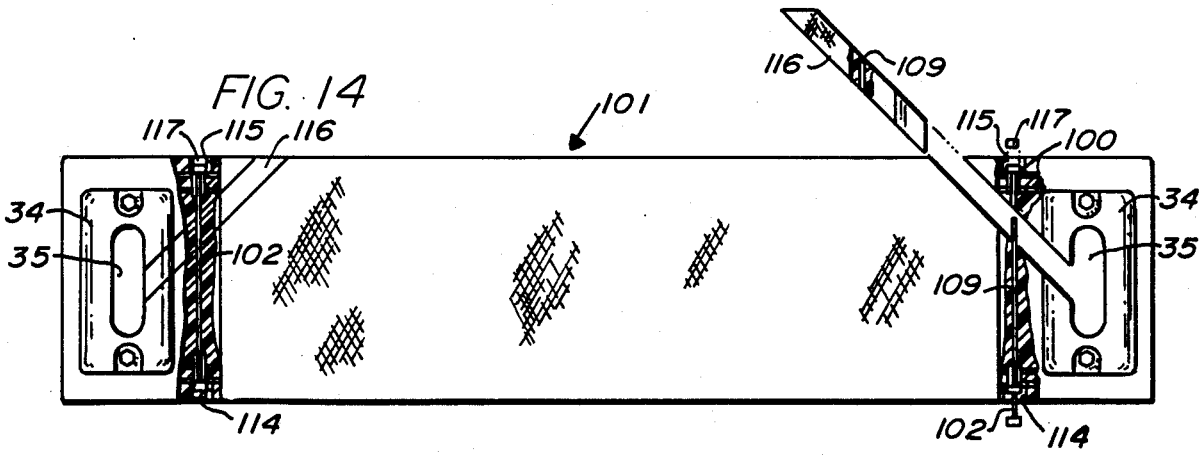

MOLDED HARD ELASTOMER STEPS AND REPLACEMENT AND SPREADER STEPS FOR ROPE LADDERS AND FITTINGS THEREFOR, AS WELL AS MOLDING METHOD THEREFOR

The present invention relates to improvements in the type of ladder steps described in U.S. Pat. No. 4,554,996 and to a new method for making those steps.

BACKGROUND OF THE INVENTION

U.S. Pat. No. 4,554,996 disclosed and claimed a rope ladder of the type in which there were two ropes on each side of an improved molded step, and in which a wedging structure secured the attachment between each step and the ropes. A strong, specially shaped, metal frame was provided, and around it was molded the body of the step.

However, some problems developed. Regardless of the amount of quality control exercised in the drilling of the bolt-receiving holes at each end, after the molding was completed, it seemed possible to obtain a perfect alignment of the holes, as was needed in order to secure the steps to the collars. Apparently, the flexibility of the molded elastomer caused the trouble. Attempts to solve this problem seemed to lead to structures that were too expensive for maintaining a competitive position.

Another problem was that when stainless steel bolts were used to avoid corrosion in salt water and when the step frame was made with a lightweight steel alloy, the two different metals were placed in contact. Then, in sea water, bimetallic corrosion resulted. This also happened with the horizontal bolts used in replacement steps like those shown in U.S. Pat. No. 4,554,996.

Also, the metal collars, were heavy, and when attempts were made to employ collars made of plastic materials, the ropes tended to slip, for suitably strong plastics tend to be slick and slippery.

SUMMARY OF THE INVENTION

Like the invention in U.S. Pat. No. 4,554,996, this invention has a series of molded, one-piece ladder steps, each with an upper surface and a lower surface, two longitudinal edges and two end edges, and each step has two spaced-apart vertical through openings, one spaced in from each transverse edge. These steps are used with two spaced-apart pairs of ropes, each pair of ropes passing through one through opening of each step. At intervals, there may also be spreader steps.

Each step is molded from hard elastomer about a strong metal frame or core having a special shape that gets nearly maximum strength for the purpose at near-minimum weight, preferably usng lightweight metal alloy, usually a steel alloy. Most of the frame is made from tubular stock, preferably square in cross-section, to achieve great strength with light weight. A pair of longitudinal tubes meet and extend beyond a transverse tube at each end, and the portion extending beyond the transverse tube is surmounted by and welded to a special metal bracket, usually lightweight steel alloy. Inboard of each transverse tube, a strengthening tube extends diagonally from one end of the transverse tube to the longitudinal tube that is connected to the other end of the transverse tube.

Special consideration is given to the area through which the rope passes. Around each rope opening, each molded step has an integral rope-surrounding portion, including the metal frame bracket, which surrounds that opening, and a molded collar-like portion extending above the step's upper surface. The molded collar-like portion defines at its upper end an opening approximately twice as long as the diameter of each rope and only about as wide as that diameter, so that the two ropes are closely confined there. The opening then increases in length transversely of the step, and at the lower surface of the step is much longer, so that each opening is tapered outwardly in length from the top to the bottom; the width of each opening remains constant.

Each step also has a pair of vertical bolt openings therethrough adjacent each through opening, and these bolt openings pass through the metal frame bracket. In the present invention, these bolt openings are provided by a special structure that ensures true alignment of the bolts. For this purpose each of the special metal brackets is provided with a vertical through opening at each end of the through opening that is for the ropes. The tubes are also provided with openings of the same size and are aligned with the openings through the metal brackets. A tubular nylon member extends through these aligned openings, and the mold is provided with projecting pin-like members that extend snugly into each end of each tubular nylon member, thereby assuring exact alignment after molding. The bolts, preferably stainless steel to avoid corrosion by salt water, when applied, extend through these nylon members, so that there is no question of misalignment.

Since the tubular nylon member is interposed between the stainless steel bolts and the lightweight steel alloy frame, the nylon tube acts as an insulator and prevents bimetallic corrosion, even in the presence of salt water. This valuable function is also important in replacement steps where there are horizontal bolts extending through portions of the frame.

As in U.S. Pat. No. 4,241,809 and U.S. Pat. No. 4,554,996 a pair of separate wedge collars is used in cooperation with each step, one below each of the through openings, bearing up against the step. The wedge collars are preferably made of nylon or other strong lightweight plastic. Each wedge collar has a step-engaging end wall and a distal end and a single elongated through opening, through which one pair of ropes passes and which at its step-engaging end is approximately the same dimensions as the bottom end of the opening through the step, where it abuts the collar. The through opening through the wedge collar tapers inwardly down to a narrower portion of the opening at the bottom, which is barely long enough for the two ropes to pass therethrough. The new feature here is the provision of a series of generally horizontal projecting ribs that lie transverse to the ropes at each end of the opening and act to prevent slippage. Each wedge collar has an elongated pair of vertical bolt passages therethrough that are molded so as to be accurately aligned with the nylon tubes through the step.

As in my earlier patents, a generally diamond-shaped wedge heart lies in between the ropes of each pair, one wedge heart lying partly in the through opening of each step and extending into the adjacent opening through the wedge collar. The wedge heart has an upper vertex spaced away from the upper outlet of the step's opening and a lower vertex at its lower end spaced away from the bottom of the opening through the wedge collar. The wedge heart is preferably of nylon or other suitable strong, lightweight plastic. It provides two rope-engaging side grooves extending between and ending at these vertices; these grooves are, in the assembly, parallel to the opposite end walls of the openings through the step and collar, respectively, and they, like the end walls of the nylon collars are provided generally with horizontal ridges that act to prevent rope slippage. When the wedge heart is fully wedged in place, the ridges in these rope-engaging grooves engage the pair of ropes in place and prevent relative movement between the ropes and the assembly of the step, the wedge collar, and the wedge heart.

A pair of bolts, preferably of stainless steel each fastened with a stainless steel nut, extend through the bolt passages of the wedge collar and through the tubular nylon members that extend through the step. The bolts hold the wedge collar, and therefore the wedge heart in place, locking the ropes in fixed position relative to the wedge heart, the step, and the wedge collar. There is one bolt just beyond each end of the transverse through opening for the ropes.

In the present invention, a replacement wedge collar may be provided by removal of a portion of one wall thereof to provide an access slot that enables rapid replacement around the rope.

The invention also provides an improved frame for spreader steps.

BRIEF DESCRIPTION OF THE DRAWINGS

In the drawings:

FIG. 1 is an isometric view of a portion of a rope ladder embodying the principles of the invention and showing three steps embodying the principles of the invention attached to two ropes. The bottom step is shown as a replacement step.

FIG. 2 is a top plan view of the reinforcing metal frame for the step, shown before molding.

FIG. 3 is a top plan cutaway view of the step, showing at the left the frame before molding and at the right the complete molded step.

FIG. 4 is a view in elevation of one of the bolt-receiving and aligning nylon tubes employed in this invention.

FIG. 5 is a fragmentary, enlarged, isometric view of one end of the frame of FIG. 2 with the nylon members of FIG. 4 in place thereon, prior to molding.

FIG. 6 is a fragmentary view in elevation and in transverse vertical section of the end portion of a completed and installed ladder step, but with one rope indicated only by broken lines and the other rope omitted.

FIG. 7 is a plan view along the line 7—7 in FIG. 6 of the nylon wedge according to this invention.

FIG. 8 is an enlarged bottom view of one of the nylon collars of the present invention.

FIG. 9 is a view in side elevation of the collar of FIG. 8, viewed along the line 9—9 in FIG. 8.

FIG. 10 is a top plan view of the collar of FIGS. 8 and 9, viewed along the line 10—10 in FIG. 9.

FIG. 11 is a view in elevation and in section of the step as contained in a mold, at the completion of molding.

FIG. 12 is a top plan view of a replacement step frame of this invention, with its cutouts.

FIG. 13 is an enlarged view in section taken along the lines 13—13 in FIG. 11, when used to mold a replacement step.

FIG. 14 is a top plan view of the molded replacement step, with a filler piece pulled out from one end.

DETAILED DESCRIPTION OF THE INVENTION

The rope ladder 20

Figure 15:
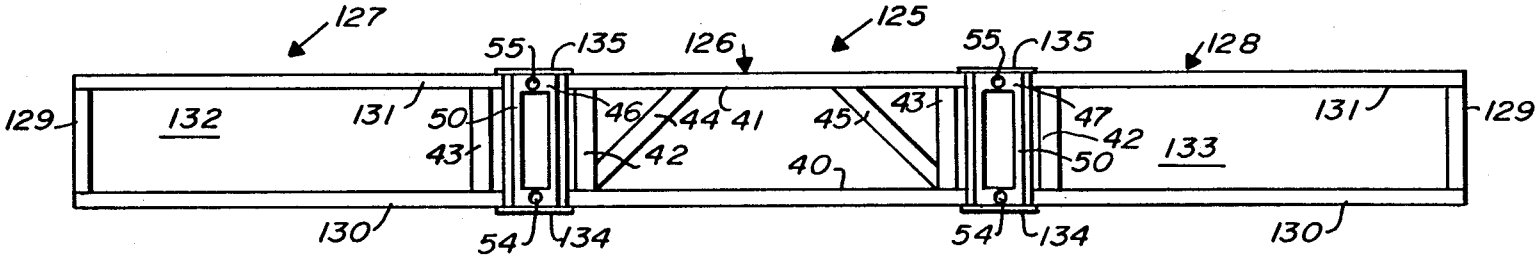
FIG. 15 is a top plan view of a spreader step frame of this invention.

FIG. 1 shows a portion of a rope ladder 20 embodying the invention. The ladder 20 is especially useful as a pilot's ladder for boarding and leaving ships, but it may also be used as a debarkation ladder or for another type of rope ladder. The ladder 20 comprises four ropes distributed as two pairs of ropes 21, 22 and 23, 24, one pair at each side of the ladder 20. The ladder 20 further comprises a series of steps 25 and by way of example a replacement step 101 at the bottom of the illustrated segment of the ladder 20. At intervals usually as prescribed by the United States Coast Guard, are a series of elongated spreader steps 125 (see FIGS. 15 and 16), which extend out well beyond the rope pairs 21, 22 and 23, 24, and help to keep the ladder 20 from turning or twisting relative to the side of a ship. The spreader steps 125 have a central portion like the step 25 and outboard portions at each end, as shown in U.S. Pat. No. 4,554,996 and at FIGS. 15 and 16. In addition, as shown in FIG. 6, the invention comprises, near each end of each step 25 and 101, a wedge collar 27 and a wedge heart 28. For a pilot's ladders 20, the steps 25 are about twenty inches long, about five inches wide, and about an inch thick at the tread.

The steps 25 (FIGS. 1 to 6 and 11)

Each step 25 comprises a metal frame 30 (See FIG. 2) about which is molded (See FIG. 3) a body 31, preferably of a suitable hard elastomer, such as a hard synthetic rubber composition. The body 31 has some flexibility but is not readily bent or flexed by hand. the body 31 has an upper tread surface 32 (See FIGS. 1 and 3), which is shaped and surfaced to reduce the likelihood of skidding or sliding thereon. The non-skid aspect of the upper surface 32 may be enhanced by first spraying a suitable paint of a type which will adhere to that surface, then adding to it grit and then coating it with paint again so as to bond the grit to the paint and, through it, to the step 25. Each step 25 also has a lower surface 33 (FIG. 1).

At each end of each step 25 is an integral raised molded collar portion 34 (FIGS. 1, 3 and 6). The integral collar portions 34 extend up from the step's top surface 32 and are in line with the separate collars 27 which abut the bottom surface 33 (FIG. 6). Each integral collar 34 encompasses a rope-receiving through opening 35 which extends through the step 25 at and below the collar portions 34. As shown in FIG. 3, the through openings 35 have vertical transverse walls 36 and, as shown in FIG. 6, tapering end walls 37, so that at the upper end 38 of the collar portion 34, the opening 35 is barely long enough to accommodate its two ropes, while at the bottom 33 of the step 25, the opening 35 is considerably longer and therefore enables use of the wedge heart 28 between each pair of ropes 21, 22, or 23, 24.

The frame 30, which can be seen in FIGS. 2, 3 and 5, preferably lightweight steel alloy, is made largely of thin but strong metal tubing, preferably square in cross-section. There are two longitudinal tubes 40 and 41; spaced inboard from each end are transverse tubes 42 and 43 that are each welded to the tubes 40 and 41. Diagonally-extending tubes 44 and 45 strengthen the structure; one end of each tube 44, 45 is welded to a transverse tube 42 or 43 near where they meet the longitudinal tube 40, and the other end is welded to the other longitudinal tube 41.

At each end of the frame 30, a metal bracket 46 or 47 surmounts and is welded to the longitudinal tubes 40 and 41. Each bracket 46, 47 has bottom flanges 48 and 49 that are welded to the tubes 40 and 41 and are connected to an upper plate portion 50 by vertical portions 51 and 52. The upper plate portion 50 surrounds and defines an opening 53 corresponding to the through opening 35, the metal therearound strengthening that portion of the step 25. The upper plate portion 50 also provided with a pair of through openings 54 and 55, one at each end. Corresponding openings pass through the longitudinal tubes 40 and 41.

In this invention the through openings 54 and 55 are made much larger than in U.S. Pat. No. 4,554,996, and a novel nylon tube 60 (See FIGS. 4 and 5) is installed through each of them before molding and remains in place after molding. The tube 60 has a preferably cylindrical shank 61, with a bore 62 large enough for the bolts to slide through, but the bore 62 is very little oversized with respect to the bolts. The shank 61 is much longer than the distance from the top of the upper plate 50 to the bottom of the tubes 40 and 41, as can be seen in FIG. 5. At its upper end, the nylon tube 60 has a disc-like flange 63, and depending projections 64 encircle the shank 61 just below the flange 63 and are unitary with it. Their purpose is to provide spacing, as indicated in FIG. 5, to space the flange 63 above the top of the plate 50. The purpose of this spacing appears in FIG. 11, where it can be seen that the step frame 30 is inverted in a mold 70 during molding and the flanges 63 rest on the bottom interior surface 71 of the lower mold half 72, at a mold portion 73. The mold portions 73 are provided in order to form recesses 56 and 57 (See FIG. 3) that receive bolt heads. In between these portions 73 the lower mold half 72 is deepened at 74 to form the top of the integral collar portion 34 of the step 25. Inversion of the step in the mold 70 helps to make molding simpler.

A very important feature of this invention is shown in FIG. 11. The mold 70 is provided with pins 75 that project upwardly from the lower mold half 72 into each nylon tube 60. The upper mold half 76 has similar pins 77 that project downwardly into the other end of each nylon tube 60. The purpose of these pins 75 and 77 is not so much to keep the elastomer from entering the bores 62 through the nylon tubes 70, although that is important also, but mainly to secure accurate alignment of the nylon tubes 70, so that when the step 25 is installed, the tubes 70 will align perfectly with bolt openings 65 through the nylon collars 27. This is very important, because heretofore there tended to be misalignment.

Since the nylon tube's flange 63 rests atop the mold portion 73 and in contact with it, that means that it remains uncovered by the elastomer 31 and that the metal frame 30 will thereby be spaced inwardly so that it will be completely covered by the elastomer 31.

When the mold is opened and the step 25 removed and turned upright, it is then ready for use or storage, and at the time of installation, is matched with one of the nylon collars 27 at each end.

The nylon collar 27 (FIGS. 8–10 and 6)

The nylon collar 27 is shown not only at the bottom of FIG. 6, but also in FIGS. 8–10. It will be noted that it provides through opening 66 that is narrow at the bottom, to be the same dimensions as the top of the opening 35 through the integral collar 34. It widens out upwardly to be the same dimensions as the bottom of the opening 35 through the step 25. Thus, its upper end 67 matches the lower end of the opening 35 through the step 25. In substance, this collar 27 is generally rectangular with an opening 66 that is rectangular in section except for rounded ends, but which lengthens transversely from bottom to top. For replacement purposes, the nylon collar 27 may be cut or sawed along the lines 68 indicated in FIG. 8 to provide a slot, so that the collar 27 can be slipped onto the ropes without having to unthread the entire ladder.

Although, in most ways, the nylon collar 27 is identical to the former steel ones, it differs in one very important particular: it is provided with generally horizontal projections 69 (See FIGS. 6 and 10) at the ends of the opening 66, which act to engage the ropes and to prevent any slippage of them.

The nylon wedge heart 28 (FIGS. 6 and 7)

The nylon wedge heart 27 is also substantially like the former steel or plastic wedge heart, except that on the upper portion of it, similar generally horizontal ribs 90 (See FIGS. 6 and 7) project inwardly to engage the rope and to prevent slippage at that point. Otherwise, the wedge heart 28 is diamond shape with two inset grooves 91 to receive one rope on each side of it.

Thus, the wedge heart 28 (FIG. 7) is of generally diamond shape (FIG. 6), having an upper vertex 92 at the top and a lower vertex 93 at the bottom and with concave rope guides or grooves 91 along its two opposite edges.

At the time of assembly, each wedge heart 28 is inserted between a pair of two ropes 21, 22 or 23, 24 and lies with its widest portion 94 at about the plane where the lower surface 33 of the step 25 and the upper surface of the wedge collar 27 meet; its upper vertex 92 lies a short distance below the upper face of the collar-like portion 34, while its lower vertex 93 lies a short distance above the lower face of the wedge collar 27. When fully wedged in place, the grooves 91 are generally parallel to the curved end walls of the openings 35 through the step 25 and to the curved end walls of the opening through the wedge collar 27. The heart 28 then locks the step 25, the wedge collar 27, and itself to the ropes 21, 22 or 23, 24, so that relative movement between them cannot take place. When properly assembled with the correct size or rope, the rope is held firmly and cannot slip.

Assembly of the step 25 and of the ladder 20

Assembly of the step 25 becomes easy in view of the nylon tubes 70 maintaining correct alignment of the bolt openings so that the unit assembly is quite simple.

The frame brackets 46 and 47 cooperate with the longitudinal tubes 40 and 41 to strengthen the step 25 in the area of the rope passages 35 and 53. When the completed step 25 is assembled into the ladder 20, bolts 96 (FIG. 6), preferably of stainless steel, pass through the bores 61 of the nylon tubes 60 and the openings 65 through the nylon collar 27, and stainless steel nuts 97 tighten the collars 27 against the bottom surface 33 of the step 25. This assures that the ropes 21, 22, 23, and 24 will be locked in place by the wedge hearts 28, in cooperation with the shaped end walls 37 of the openings 35 and the openings 66. Moreover, the cross-tubes 42 and 43 and the diagonal tubes 44 and 45, being welding to the longitudinal tubes 40 and 41, support the body 31 of the molded step 25 and strengthen the whole, while the ribs 69 and 90 engage the ropes and prevent slippage.

The nylon tubes 60 insulate between the stainless steel bolts 96 and the frame 30, including the brackets 46 and 47, all of which are normally made of lightweight metal alloy, such as a steel alloy. Thus, even when flooded by seawater, the metal members are protected from the kind of corrosion caused by the use of two different types of metal and their electrolytic reaction with seawater.

The replacement Steps 101 (FIGS. 12–14)

Nylon tubes 100 generally like the nylon tubes 60 but without the spacers 64 act to prevent bimetallic corrosion of the horizontal bolts 102 used in the replacement steps 101.

The replacement steps 101 of this invention may be like those shown in U.S. Pat. No. 4,554,996 or they may be somewhat different. As will now be described. Their manufacture starts with the frame 30 as shown in FIG. 2. As shown in FIG. 12 the frame 30 may be cut before the molding to provide two gaps or notches 103 in the square tubular longitudinal member 41. These gaps 103 have angularly inclined edges 104 and 105. The members 42 and 43 are similarly cut, as are the brackets 46 and 47. Moreover, horizontal bolt openings 106 are precut in the horizontal members 40 and 41 to receive the nylon tubes 100.

For molding, the nylon tubes 100 are put in place, with their respective heads 107 abutting the frame members 40, 41 and their respective shanks 108 going all the way through the openings 106 of the respective frame members 40 and 41. Then, to hold the tubes 100 in place and mold an opening 109 through the body 31, a slug bolt 110 with a thick round head 111 is inserted from one nylon tube 100 to and through the other tube 100. These slug bolts 110 are held in place by slug nuts 112. The slug bolts 110 are threaded only at the distal end and have a smooth shank 113.

During molding of the rubber body 31, the slug bolts 110 and the nylon tube 100 provide the through opening 109 with countersunk recesses 114 and 115 at each end. The gaps or notches 103 are filled with the hard elastomer, as are the gaps cut through the members 42 and 43 and the bracket 46 and 47.

After molding is completed and the replacement step 101 removed from the mold, the slugs bolts 110 and their slug nuts 112 are removed. The rubber in the gaps 103 and the gaps through the other portions of the frame 30 is then cut out leaving the step 101 as shown in FIG. 14 to provide two filler members 116 that are generally trapezoidal as viewed in plan. Each filler member 116 has a segment of the opening 109 that was formed during molding and mates with the remainder of the opening 109.

When the replacement step 101 is used to replace a step 25, the ropes 21, 22, 23 and 24 are inserted through the gaps or notches 103 into the openings 35. The filler members 116 are then inserted into the notches 103 with the opening 109 recreated by proper alignment. When the stainless steel bolts 102 are inserted through the nylon tubes 100 and the opening 109 and are fastened by stainless steel nuts 117. The nylon tubes 100 insulate the bolts 102 from the metal frame members and prevent bimetallic induced corrosion in the presence of sea water. The filler members 116 are then held firmly in place, while the ropes are held by the wedge assembly as before.

Figure 16:
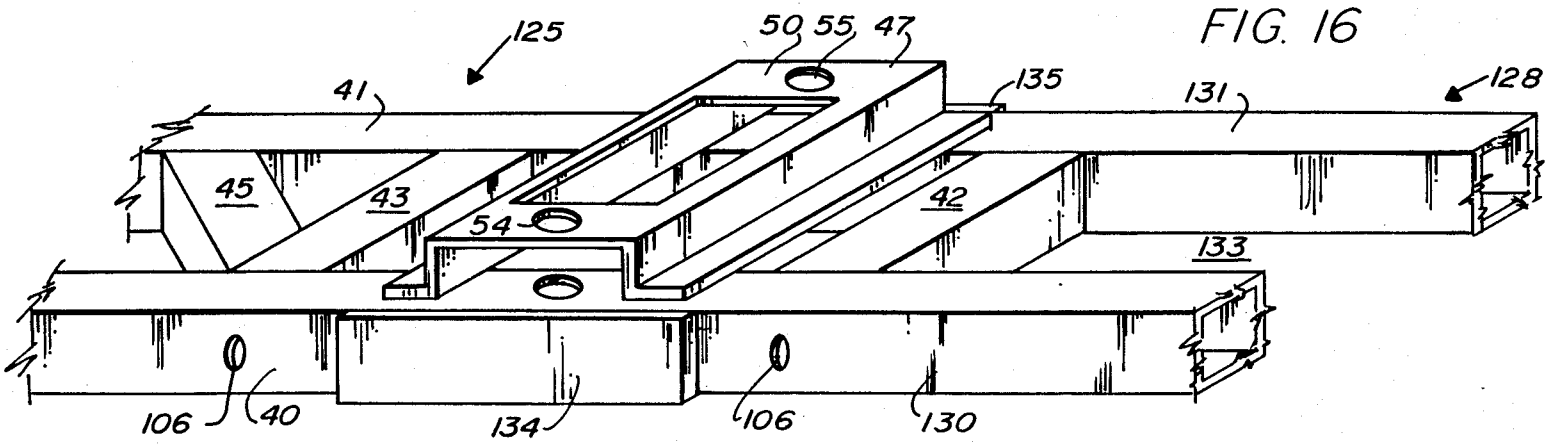
FIG. 16 is fragmentary view in perspective of a portion of FIG. 15.

The improved spreader step 125 (FIGS. 15 and 16)

At prescribed intervals each pilot ladder has a spreader step 125. Its central portion 126 is like the step 25. Beyond this central portion 126 at each end is an outboard portion 127 or 128, joined at their outboard ends by transverse frame members 129. Their longitudinal frame members 130 and 131 may be identical to and integral with the frame members 40 and 41 or may be welded to them. Through openings 132 and 133 are left, as handholds and wind passages. In this invention strength is provided at the weak juncture area of the frame members 40, 41 with the members 130 and 131, the weakness being due to the rope receiving openings 35, by steel plates 134 and 135 welded firmly to the outside surface of frame member 40, 41 and extending to and welded to the frame members 130 and 131.

To those skilled in the art to which this invention relates, many changes in construction and widely differing embodiment and applications of the invention will suggest themselves without departing from the spirit and scope of the invention. The disclosures and the descriptions herein are purely illustrative and are not intended to be in any sense limiting.

What is claimed is:

1. In a rope ladder of the type having a series of ladder steps, and two spaced-apart pairs of ropes, the combination of:

a metal step frame with a pair of longitudinal members joined by a pair of shorter transverse members spaced in from the ends and strengthened by a pair of diagonal members, and having at each end a metal bracket bridging across the pair of longitudinal members and having vertical portions leading to an upper plate portion, which defines a generally rectangular opening, each said upper plate portion having a vertical through opening at each end, one spaced from each end of said rectangular opening, each said longitudinal member having vertical through openings accurately aligned with the through openings of said upper plate portion, to make sets of said vertical through openings, tubular nylon members with cylindrical bores, extending vertically through said sets of through openings and assuring their accurate alignment, a molded hard elastomer body molded around said frame and tubular nylon members and having a collar portion at each end molded around a said bracket, said body having a rope-receiving opening through each collar portion and the body therebelow and in line with the rectangular openings through said brackets, each said rope-receiving opening being narrow at its upper end for closely confining said pair of ropes and enlarging out transversely of the step toward the lower end, each rope-receiving opening thus tapering inwardly from bottom to top, the bores of said tubular nylon members providing each said step with vertical bolt openings through said body adjacent each said rope-receiving opening, and a pair of separate wedge collars for each said step, one at each end of and below said step and bearing up against it, each said wedge collar having a rope-receiving opening whose upper end has approximately the same dimensions as those of said step's rope-receiving opening where it emerges from its lower surface, said collar's rope-receiving opening tapering inwardly therefrom down to a narrow portion at the lower end, for closely confining the two ropes, each said wedge collar having vertical bolt passages therethrough aligned with the bores of said tubular nylon members, a generally diamond-shaped wedge heart in between the ropes of each pair of ropes, in said rope-receiving openings, said wedge heart providing two rope-engaging side grooves for locking the pair of ropes in place and preventing relative movement between them and said step, and fastening means extending through said bolt passages and said bores of said nylon members and tightened in place to hold said wedge collar and wedge heart in place and lock said ropes in fixed position relative to said step.

2. The ladder of claim 1 wherein each said wedge collar is a molded nylon member, its tapered rope-receiving opening having a series of transverse generally horizontal ridges in the walls thereof to prevent rope slippage.

3. The ladder of claim 2 wherein said wedge heart is a molded nylon member with its rope-engaging side grooves each having walls with a series of transverse generally horizontal ridges to prevent rope slippage.

4. A molded nylon replacement wedge collar for a ladder of claim 1, each said replacement wedge collar having a slot on one side leading into said through opening.

5. The ladder of claim 1 wherein each said nylon member has a circular flange at its upper end flush with the upper surface of its said collar portion, and a spacer portion below said flange, resting on said upper plate portion and spacing the upper end of said flange from said upper plate portion, the elastomer of said body filing the space thereby provided.

6. The ladder of claim 5, wherein each said nylon member terminates flush with the lower surface of said body.

7. A replacement step for the ladder of claim 1 like the step set forth therein with the addition of:

a diagonal slot leading from one longitudinal edge of the step through said frame and said body into said rope-receiving opening, a filler member filling said slot, horizontal nylon tubes near each end of each said step, extending horizontally and transversely from each said longitudinal edge of the step toward the other longitudinal edge, through a portion of said step body, and a portion of said step frame, and fastening means extending through said horizontal nylon tubes, and from one longitudinal edge to the other through said filler member, holding said step and said filler member together.

8. The replacment step of claim 7 wherein said filler member is made of said hard elastomer unreinforced by any portion of said step frame.

9. The replacement step of claim 7 wherein there is a pair of said nylon tubes at each and of said step, each having a circular flange at one end bearing against its said longitudinal edge and a cylindrical tubular shank extending through the longitudinal member adjacent that said edge, said step frame being made of light-weight metal alloy and said fastening means of stainless steel, said nylon tubes insultaing between said frame and said fastening means so as to prevent bimetallic corrosion.

10. A spreader step for the rope ladder of claim 1, having a central portion like an aforesaid step but with a pair of outboard portions that include extended portions of said longitudinal frame members joined at their outboard ends by transverse frame members, said outboard portions having openings between said extended portions to provide handholds, lightness, and wind passages therethrough, said outboard portions also having a pair of steel plates, each welded to the outside edge of each said longitudinal frame member from inboard of each said rope-engaging opening to the adjacent portion of said extended portions thereof.

11. In a rope ladder of the type having a series of ladder steps, each with an upper surface and a lower surface, two longitudinal edges and two end edges, and two spaced-apart pairs of ropes, the improvement wherein each said step has:

a unitary metal frame with a pair of longitudinal members joined by a pair of shorter transverse members and strengthened by a pair of diagonal members, each extending from one end portion of a transverse member to the longitudinal member that is joined to the opposite end of the transverse member, all said longitudinal, transverse, and diagonal members being welded together, said frame also having at each end a metal bracket resting atop and welded to and bridging across the pair of longitudinal members outboard of said transverse member, said brackets having vertical portions leading up to an upper plate portion, which defines a generally rectangular opening, each said upper plate portion having a vertical through opening at each end, one spaced from each end of said rectangular opening, each said longitudinal member having its vertical through openings aligned with the through openings of said upper plate portion, to make sets of said vertical through openings, tubular nylon members extending vertically through said sets of through openings and assuring their accurate alignment, each said nylon member having a cylindrical bore therethrough, a molded hard elastomer body molded around said frame and said tubular nylon members and having a collar portion at each end molded around a said bracket, said body having two spaced-apart vertical rope-receiving openings, one through each said collar portion and the body therebelow and in line with the generally rectangular openings through said brackets, each said rope-receiving opening through said body being narrow at its upper end for closely confining said ropes and being much longer where it emerges from said lower surface, tapering inwardly from bottom to top, the bores of said tubular nylon members providing each said step with vertical bolt openings therethrough adjacent each said rope-receiving opening, extending through both said frame and said body, a pair of separate wedge collars for each said step, one at each end of and below said step and bearing up against it, each said wedge collar having a rope-receiving opening whose upper end is approximately the same width as said body's rope-receiving opening where it emerges from its lower surface, said collar's rope-receiving opening tapering inwardly therefrom down to a narrow portion at the lower end for closely confining the two ropes, each said wedge collar having vertical bolt passages therethrough aligned with the bores of said tubular nylon members, a generally diamond-shaped wedge heart in between the said ropes of each pair of ropes, a said heart lying in each rope-receiving opening of each body and extending into the elongated rope-receiving opening of the wedge collar, said wedge heart having an upper vertex adjacent and spaced down from said upper end of said body's rope-receiving opening and a lower vertex adjacent and spaced up from the bottom of the elongated rope-receiving opening of said wedge collar, and providing two rope-engaging side grooves extending between and ending at said vertices, so that these rope-engaging grooves, when said wedge heart is fully wedged in place, lock the pair of ropes in place and prevent relative movement between them and said step, said wedge collar and said wedge heart, and fastening means extending through the belt passages of each wedge collar and the bores of said nylon members and tightened in place to hold said wedge collar and wedge heart in place and lock said ropes in fixed position relative to said wedge heart, said step, and said wedge collar.

12. The ladder of claim 11 wherein said longitudinal, transverse, and diagonal members of said frame comprise square tubing, the longitudinal members having upper and lower horizontal portions through which extend the vertical through openings.

13. The ladder of claim 11 wherein each said wedge collar is a molded nylon member, its tapered rope-receiving opening having a series of transverse generally horizontal ridges in the walls thereof engagement of the ropes to prevent rope slippage.

14. The ladder of claim 11 wherein said wedge heart is a molded nylon member with its rope-engaging side grooves each having walls with a series of generally horizontal transverse ridges engaging the ropes to prevent rope slippage.

15. The ladder of claim 11 wherein each said nylon member has a circular flange at its upper end flush with the upper surface of its said collar portion, and a spacer portion below said flange, resting on said upper plate portion and spacing the upper end of said flange from said upper plate portion, the elastomer body filing the space thereby provided.

16. The ladder of claim 15, wherein each said nylon member terminates flush with the lower surface of said body.

17. The improvement of claim 11 wherein said step is a replacement step for the ladder and is like the step set forth therein with the addition of:

a diagonal notch leading from one longitudinal edge of the step through said frame and said body, into said rope-receiving opening, a filler member filling said notch, a pair of horizontal nylon tubes adjacent and inboard from each said rope-receiving opening extending horizontally and transversely through said step body, said step frame, and said filler member, one said tube extending in from each said longitudinal edge of the step toward the other longitudinal edge, and fastening means extending through said horizontal nylon tubes, holding said step and said filler member together.

18. The improvement of claim 17 wherein said filler member is made of said hard elastomer unreinforced by any portion of said step frame.

19. A rope ladder of the type having a series of ladder steps, each with an upper surface and a lower surface, two longitudinal edges and two end edges, and two spaced-apart pairs of ropes, the improvement wherein each said step has:

a unitary metal frame with a pair of longitudinal, square tubes joined by a pair of shorter transverse square tubes and strengthened by a pair of diagonal square tubes each extending from one end portion of a transverse tube on the inboard side thereof, to the longitudinal tube that is joined to the opposite end of the transverse tube, all said longitudinal, transverse, and diagonal tubes being welded together, said frame also having at each end a metal bracket resting atop and welded to and bridging across the pair of longitudinal tubes outboard of said transverse tubes, each said bracket having vertical portions leading up to an upper plate portion, which defines a generally rectangular opening, each said upper plate portion having a vertical through opening at each end, one spaced from each end of said rectangular opening, each said longitudinal member having vertical through openings aligned with the through openings of said upper plate portion, to make sets of said vertical through openings, tubular nylon members having cylindrical bores and extending vertically through said sets of through openings and assuring their accurate alignment, a molded hard elastomer body molded around said frame and said tubular nylon members and having an integral collar porton at each end molded around a said bracket, said body having two spaced-apart vertical rope-receiving openings, one through each said collar portion and the body therebelow and in line with the openings through said brackets, each said rope-receiving opening of said body being narrow at its upper end for closely confining said ropes and being much longer where it emerges from said lower surface, each rope-receiving opening of said body tapering inwardly from bottom to top, said tubular nylon members providing each said step with two vertical openings therethrough, one adjacent each of the opposite ends of each said body's rope-receiving opening, extending through both said frame brackets and longitudinal tubes and through said body, and enclosing said tubular nylon members, a pair of separate wedge collars for each said body, one at each end of and below said step and bearing up against it, each said wedge collar having a rope-receiving opening whose upper end is approximately the same width as said body's rope-receiving opening where it emerges from its lower surface, said collar's rope-receiving opening tapering inwardly therefrom down to a narrow portion at the lower end for closely confining the two ropes, each said wedge collar having vertical bolt passages therethrough aligned with the bores through said tubular nylon members, a generally diamond-shaped wedge heart in between the said ropes of each pair of ropes, a said heart lying in each rope-receiving opening of each body and extending into the elongated rope-receiving opening of the wedge collar, said wedge heart having an upper vertex adjacent and spaced down from said upper end of said body's rope-receiving opening and a lower vertex adjacent and spaced up from the bottom of the elongated rope-receiving opening of said wedge collar, and providing two rope-engaging side grooves extending between and ending at said vertices, so that these rope-engaging grooves, when said wedge heart is fully wedged in place, hold the pair of ropes in place and prevent relative movement between them and said step, said wedge collar and said wedge heart, and bolts extending through the bolt passages of each wedge collar and the bores of said tubular nylon members with nuts tightened on them to hold said wedge collar and wedge heart in place and lock said ropes in fixed position relative to said wedge heart, said step, and said wedge collar.

20. A step for a rope ladder of the type having spaced-apart pairs of ropes, comprising a metal frame with a pair of longitudinal members joined by a pair of shorter transverse members spaced in from the ends and strengthened by a pair of diagonal members, and having at each end a metal bracket bridging across the pair of longitudinal members and having vertical portions leading to an upper plate portion, which defines a generally rectangular opening, each said upper plate portion having a vertical through opening at each end, one spaced from each end of said rectangular opening, each said longitudinal member having vertical through openings aligned with the through openings of said upper plate portion, to make sets of said vertical through openings, tubular nylon members extending vertically through said sets of through openings and assuring accurate alignment, said nylon members having cylindrical bores therethrough, and a molded hard elastomer body molded around said frame and said tubular nylon members and having a collar portion at each end molded around a said bracket, said body having a rope-receiving opening through each said collar portion and the body therebelow and in line with the generally rectangular openings through said brackets, each said rope-receiving opening being narrow at its upper end for closely confining said pair of ropes and enlarging toward its lower end, each rope-receiving opening tapering inwardly from bottom to top, said tubular nylon members providing each said step with vertical bolt openings therethrough adjacent each said rope-receiving opening.

21. The step of claim 20 wherein said metal frame comprises a pair of longitudinal, square tubes joined by a pair of shorter transverse square tubes and strengthened by a pair of diagonal square tubes, each extending from one end portion of a transverse tube on the inboard side thereof to the longitudinal tube that is joined to the opposite end of the transverse tube, all said longitudinal, transverse, and diagonal tubes being welded together, said metal bracket resting atop and welded to the pair of longitudinal tubes outboard of said transverse tubes.

22. The ladder of claim 21 wherein each said nylon member has a circular flange at its upper end flush with the upper surface of its said collar portion, and a spacer portion below said flange, resting on said upper plate portion and spacing the upper end of said flange from said upper plate portion, the resulting space being filled by the elastomer of said body.

23. The ladder of claim 22, wherein each said nylon member terminates flush with the lower surface of said body.

24. A replacement step for a rope ladder of the type having spaced-apart pairs of ropes, comprising a metal frame with a pair of longitudinal members joined by a pair of shorter transverse members spaced in from the ends and strengthened by a pair of diagonal members, and having at each end a metal bracket bridging across the pair of longitudinal members and having vertical portions leading to an upper plate portion, which defines a generally rectangular opening, each said upper plate portion having a vertical through opening at each end, one spaced from each end of said rectangular opening, each said longitudinal member having vertical through openings aligned with the through openings of said upper plate portion, to make sets of said vertical through openings, said frame having a diagonal notch leading from one longitudinal edge of the frame through said frame into said rectangular opening, said frame also having a pair of horizontal transverse openings adjacent each said rope-receiving opening and inboard therefrom, a molded hard elastomer body molded around said frame and said tubular nylon members and having a collar portion at each end molded around a said bracket, said body having a rope-receiving opening through each said collar portion and the body therebelow and in line with the generally rectangular openings through said brackets, each said rope-receiving opening being narrow at its upper end for closely confining said pair of ropes and enlarging toward its lower end, each rope-receiving opening tapering inwardly from bottom to top, said body having a pair of notches corresponding to that of said frame, extending into said rope-receiving openings, a filler member filling each said notch and having a horizontal opening therethrough, tubular nylon members extending vertically through said sets of through openings and assuring accurate alignment, said nylon members having cylindrical bores therethrough, said tubular nylon members providing each said step with vertical bolt openings therethrough adjacent each said through opening fastening means extending through said tubular nylon members, a pair of horizontal nylon tubes one for each said longitudinal edge of said frame at each end, extending horizontally and transversely through said horizontal openings of said frame and through a portion of said step body, each extending from a said longitudinal edge of the step toward the opposite longitudinal edge, and fastening means extending through said horizontal nylon tubes and through said filler member, holding said step and said filler member together.

25. The replacement step of claim 24 wherein said filler member is made of said hard elastomer unreinforced by any portion of said step frame.

26. A spreader step for a rope ladder of the type having spaced-apart pairs of ropes, comprising a metal frame having a central portion with a pair of longitudinal members joined by a pair of shorter transverse members spaced in from the ends and strengthened by a pair of diagonal members, and having at each end a metal bracket bridging across the pair of longitudinal members and having vertical portions leading to an upper plate portion, which defines a generally rectangular opening, each said upper plate portion having a vertical through opening at each end, one spaced from each end of said rectangular opening, each said longitudinal member having vertical through openings aligned with the through openings of said upper plate portion, to make sets of said vertical through openings, said frame also having a pair of outboard portions that include extended portions of said longitudinal frame members joined at their outboard ends by transverse frame members and also having a pair of steel plates welded to the outside edge of each said longitudinal frame member from inboard of each said bracket to the adjacent portion of said extended portions thereof, tubular nylon members extending vertically through said sets of through openings and assuring accurate alignment, said nylon members having cylindrical bores therethrough, and a molded hard elastomer body molded around the central portion of said frame and said tubular nylon members and having a collar portion at each end molded around a said bracket, said body having a rope-receiving opening through each said collar portion and the body therebelow and in line with the generally rectangular openings through said brackets, each said rope-receiving opening being narrow at its upper end for closely confining said pair of ropes and enlarging toward its lower end, each rope-receiving opening tapering inwardly from bottom to top, said tubular nylon members providing each said step with vertical bolt openings therethrough adjacent each said through opening, said molded body being molded around said extended portions of said longitudinal frame portions and having openings through each said outboard portion between said extended portions to provide handholds, lightness, and wind passages therethrough.

27. A step for a rope ladder of the type having spaced-apart pairs of ropes, comprising a metal frame with a pair of longitudinal members joined by crossing members and having at each end a metal bracket bridging across the pair of longitudinal members and having generally vertical portions leading to an upper plate portion, which defines a generally rectangular opening, each said upper plate portion having a vertical through opening at each end, one spaced from each end of said rectangular opening, each said longitudinal member having vertical through openings aligned with the through openings of said upper plate portion, to make sets of said vertical through openings, tubular nylon members extending vertically through said sets of through openings and assuring accurate alignment, said nylon members having cylindrical bores therethrough, and a molded hard elastomer body molded around said frame and said tubular nylon members and having a collar portion at each end molded around a said bracket, said body having a rope-receiving opening through each said collar portion and the body therebelow and in line with the generally rectangular openigns through said brackets, each said rope-receiving opening being narrow at its upper end for closely confining said pair of ropes and enlarging toward its lower end, each rope-receiving opening tapering inwardly from bottom to top, said tubular nylon members providing each said step with vertical bolt openings therethrough adjacent each said through opening.

28. A method of molding steps for a rope ladder, comprising the steps of providing a metal step frame having a pair of longitudinal members joined by a pair of shorter transverse members spaced in from the ends and strengthened by a pair of diagonal members, and having at each end a metal bracket bridging across the pair of longitudinal members and having vertical portions leading to an upper plate portion, which defines a generally rectangular opening, each said upper plate portion having a vertical through opening at each end, one spaced from each end of said rectangular opening, each said longitudinal member having vertical through openings accurately aligned with the through openings of said upper plate portion, to make sets of said vertical through openings, inserting a tubular nylon member with a cylindrical bore vertically through each said set of through openings, said nylon member having a flange at one end and spacer means therebelow and an opposite, lower end, extending beyond the bottom of said frame, inverting said frame with the nylon members therein, inserting the inverted frame into a mold, with each said nylon member's flange resting on a lower mold interior surface and spacing said upper plate thereabove, the lower end of said nylon member engaging an upper mold interior surface, said upper and lower mold interior surfaces each having a plurality of pins, each pin extending into said nylon member, so that a pin extends into each end of each said nylon member to prevent entry of elastomer thereinto and to assure accurate alignment of said nylon member during molding, molding a molded hard elastomer body around said frame and said tubular nylon members to provide a collar portion at each end molded around a said bracket, said mold being shaped to provide said body with a rope-receiving opening through each collar portion and the body therebelow and in line with the rectangular openings through said brackets, the bores of said tubular nylon members providing each said step with vertical bolt openings therethrough adjacent each said through opening.

29. The method of claim 28 wherein said lower mold half is shaped to form each said through opening to be narrow at an upper end, when re-inverted, for closely confining said pair of ropes and to widen out transversely of the step toward its lower end, each through opening, thus tapering inwardly from bottom to top.

30. The method of claim 28 wherein each said longitudinal frame member is drilled before molding to provide a pair of horizontal through openings, each adjacent to and inboard from a said bracket, the horizontal openings through one said longitudinal member being aligned with those of the other said longitudinal frame member, before the molding step inserting at each end of the step frame a pair of flanged horizontal nylon tubes through the horizontal openings of each said longitudinal frame member from the outer edge thereof toward the other edge, the flange of each tube being on the outer edge of its frame member, and securing before the molding step, a removable slug bolt to extend transversely fully across the step frame through both nylon tubes of each pair and tightening it in place with a slug nut, to provide countersunk recesses adjacent the flanges of said nylon tubes.

31. The method of claim 30 comprising, after the molding step cutting two diagonal slots from one longitudinal edge of the step into each said rope-receiving opening, to provide simultaneously a filler member for each said slot.

32. A method of molding steps for a rope ladder, comprising the steps of providing a metal step frame having a pair of longitudinal members bridged at each end by a metal bracket having generally vertical portions leading to an upper plate portion which defines a generally rectangular opening, each said upper plate portion having a vertical through opening at each end, one spaced from each end of said rectangular opening, each said longitudinal member having vertical through openings aligned with the through openings of said upper plate portion, to make sets of said vertical through openings, inserting a tubular nylon member with a cylindrical bore vertically through each said set of through openings, said nylon member having a flange at one end and spacer means therebelow and an opposite, lower end, extending beyond the bottom of said frame, inverting said frame with the nylon members therein, inserting the inverted frame into a mold, with each said nylon member's flange resting on a lower mold interior surface and spacing said upper plate thereabove, the lower end of said nylon member engaging an upper mold interior surface, said upper and lower mold interior surfaces each having a plurality of pins, each pin extending into said nylon member, so that a pin extends into each end of each said nylon member to prevent entry of elastomer thereinto and to assure accurate alignment of said nylon member during molding, molding a molded hard elastomer body around said frame and said tubular nylon members to provide a collar portion at each end molded around a said bracket, said mold being shaped to provide said body with a through opening through each collar portion and the body therebelow and in line with the openings through said brackets, the bores of said tubular nylon members providing each said step with vertical bolt openings therethrough adjacent each said through opening.

* * * * *